US005691962A

United States Patent [19]

Schwartz et al.

[11] Patent Number: 5,691,962

[45] Date of Patent: Nov. 25, 1997

[54] WRISTWATCH WITH ILLUMINATION SYSTEM FOR MULTIPLE DIGITAL AND ANALOG STYLES

[75] Inventors: Herbert Schwartz, Wurmberg; Friedrich Mose, Pforzheim, both of Germany; Michel Plancon, Besancon, France

[73] Assignee: Timex Corporation, Middlebury, Conn.

[21] Appl. No.: 562,557

[22] Filed: Nov. 24, 1995

[51] Int. Cl.[6] ..... G04B 25/00

[52] U.S. Cl. ..... 368/71; 368/88; 368/226

[58] Field of Search ..... 368/226, 82–84, 368/88, 71, 239–242

[56] References Cited

U.S. PATENT DOCUMENTS

| | | | |
|---|---|---|---|
| 3,641,967 | 2/1972 | Charbonneaux . | |
| 4,208,869 | 6/1980 | Hanaoka | 368/84 |
| 4,775,964 | 10/1988 | Alessio et al. | 368/67 |
| 5,202,858 | 4/1993 | Kanzaki | 368/71 |
| 5,265,071 | 11/1993 | Thorgersen et al. | 368/67 |

OTHER PUBLICATIONS

Page from Casio Computer Co., Ltd. product catalog, date unknown.

*Primary Examiner*—Bernard Roskoski

*Attorney, Agent, or Firm*—William C. Crutcher

[57] ABSTRACT

An improved illuminated watch movement with analog and digital features comprising a frame containing an analog stepping motor and gear train connected to operate timepiece hands located substantially in the center of the movement. The frame has a recess on the dial side of the frame with a liquid crystal display disposed in the recess and having an indicia pattern. The liquid crystal display has a large available surface which covers the lower half of the movement up to the hour wheel, so that a variety of indicia patterns may be displayed. An electroluminescent lamp is disposed beneath said liquid crystal display. An electroluminescent dial is disposed on the dial side of the frame and has a window opening framing the indicia pattern. A circuit with actuators is connected to actuate the electroluminescent lamp and/or the electroluminescent dial. The movement further includes a printed circuit board disposed on the opposite side of the frame from the dial and having contact pads. Yieldable electrical connectors such as spring metal or conductive elastomeric members extend across the frame between the contact pads and the electroluminescent dial and lamp. The movement is adapted to fit a variety of dial shapes with window openings for framing a variety of indicia patterns without significant physical alterations.

7 Claims, 8 Drawing Sheets

WRISTWATCH WITH ILLUMINATION SYSTEM FOR MULTIPLE DIGITAL AND ANALOG STYLES

BACKGROUND OF THE INVENTION

This invention relates generally to electronic timepieces with illuminated display of time or other information, presented either in analog or digital format. More particularly, the invention relates to a wristwatch with electroluminescent illumination systems for multiple digital and analog styles.

Analog wristwatches are known which have electroluminescent dials for viewing the time when the ambient light level is too low to easily see the dial. Examples of such electroluminescent dials used in timepieces may be seen in U.S. Pat. No. 4,775,964 issued Oct. 4, 1988 to Alessio et al. It is also known that a liquid crystal display of the type commonly used in digital timepieces may be illuminated from behind by an electroluminescent lamp, one such construction being shown in U.S. Pat. No. 4,208,869 issued Jun. 24, 1980 to Hanaoka. In either case, the timepiece requires a special electroluminescent drive circuit to convert the voltage of the energy cell to a form suitable for causing the electroluminescent material to light up and illuminate the display. One suitable type of electroluminescent drive circuit is shown in U.S. Pat. No. 4,527,096 issued Jul. 2, 1985 to Kindlmann, and other types of drive circuits are also shown in the aforementioned Hanaoka patent.

Special constructions are needed to connect the electroluminescent (EL) electrodes (or conductive layers) to the printed circuit board (PCB) containing the drive circuit. One such arrangement is shown in U.S. Pat. No. 5,265,071 issued Nov. 23, 1993 to Thorgersen et al., utilizing elastomeric conductive connectors between the printed circuit board and the electroluminescent electrode layers on an analog watch dial.

When designing a combination digital and analog watch, the designer has much less freedom in placement of the components of the watch. The designer is actually combining two different types of timepieces into a single movement, which must provide for space to locate a liquid crystal display, as well as space to locate the stepping motor and gear train to turn analog watch hands. While it is relatively easy to simply insert two separate movements, one analog and one digital, side-by-side into a watch case, it is much more difficult to integrate the separate watch technologies into a single movement having both analog and digital features and having axis of rotation of the analog hands located in the center of the movement.

An additional problem in an illuminated EL wristwatch is to provide for connections both to the electroluminescent electrodes on the watch dial, and to electrodes of the electroluminescent lamp illuminating the liquid crystal display. The designer may also wish to provide for a single manual actuator, or for separate actuators so that either display may be illuminated at will. Because of the great expense and effort required to design a suitable illuminated combination analog and digital watch movement, the designer tries to avoid creating a new movement for different watch styles wanted by the consumers. It would be desirable to provide a construction which does not require substantial changes or redesigns as the watch styles change.

Accordingly, one object of the present invention is to provide an improved combination analog and digital timepiece with illumination provisions for both the analog and digital displays.

Another object of the invention is to provide an improved combination analog and digital wristwatch movement in which analog and digital features are integrated into a single movement with analog hands located substantially in the center of the movement.

Another object of the invention is to provide such a design which may be used with several different watch styles with a minimum change of components.

SUMMARY OF THE INVENTION

Briefly stated, the invention comprises an improved illuminated watch movement with analog and digital features comprising a frame containing an analog stepping motor and gear train connected to operate timepiece hands rotating coaxially with an hour wheel having its axis located substantially in the center of the movement, the frame defining a recess on a dial side of the frame, a liquid crystal display disposed in said recess and having an indicia pattern thereon, an electroluminescent lamp disposed beneath said liquid crystal display, an electroluminescent dial disposed on the dial side of the frame and defining a window opening therethrough flaming the indicia pattern, and means connected to actuate the electroluminescent lamp and/or the electroluminescent dial. The liquid crystal display has an available surface extending across the width of the frame and from an edge of the frame up to the outer edge of the hour wheel. The movement in its preferred form includes a printed circuit board disposed on an opposite side of the frame from the dial and having a plurality of contact pads thereon, and a plurality of yieldable electrical connectors extending across the frame between the contact pads and the electroluminescent dial and lamp. The movement is adapted to fit a variety of dial shapes and window openings for framing a variety of indicia patterns without significant physical alterations.

DRAWING

The invention will best be understood by reference to the following description, taken in connection with the accompanying drawings, in which:

FIG. 1 is a front perspective view of a combination analog and digital timepiece according to the present invention, FIG. 2 is a top perspective view of the dial side of the movement with portions of the dial removed to expose the frame construction, FIG. 3 is a bottom perspective view of the frame from the movement side with the energy cell in place, FIG. 4 is a back perspective view of the frame with the energy cell, printed circuit board and gear train bridge removed, FIG. 5 is a side elevational drawing in cross section, with frame outline only in phantom lines, FIGS. 6 and 7 are segment wiring layout and common wiring layout respectively of one indicia pattern on the two plates of a liquid crystal display, and FIGS. 8–15 are exploded front perspective drawings of several different designs of combination analog and digital wristwatches using the present invention.

DESCRIPTION OF THE PREFERRED EMBODIMENT

Figure 1:
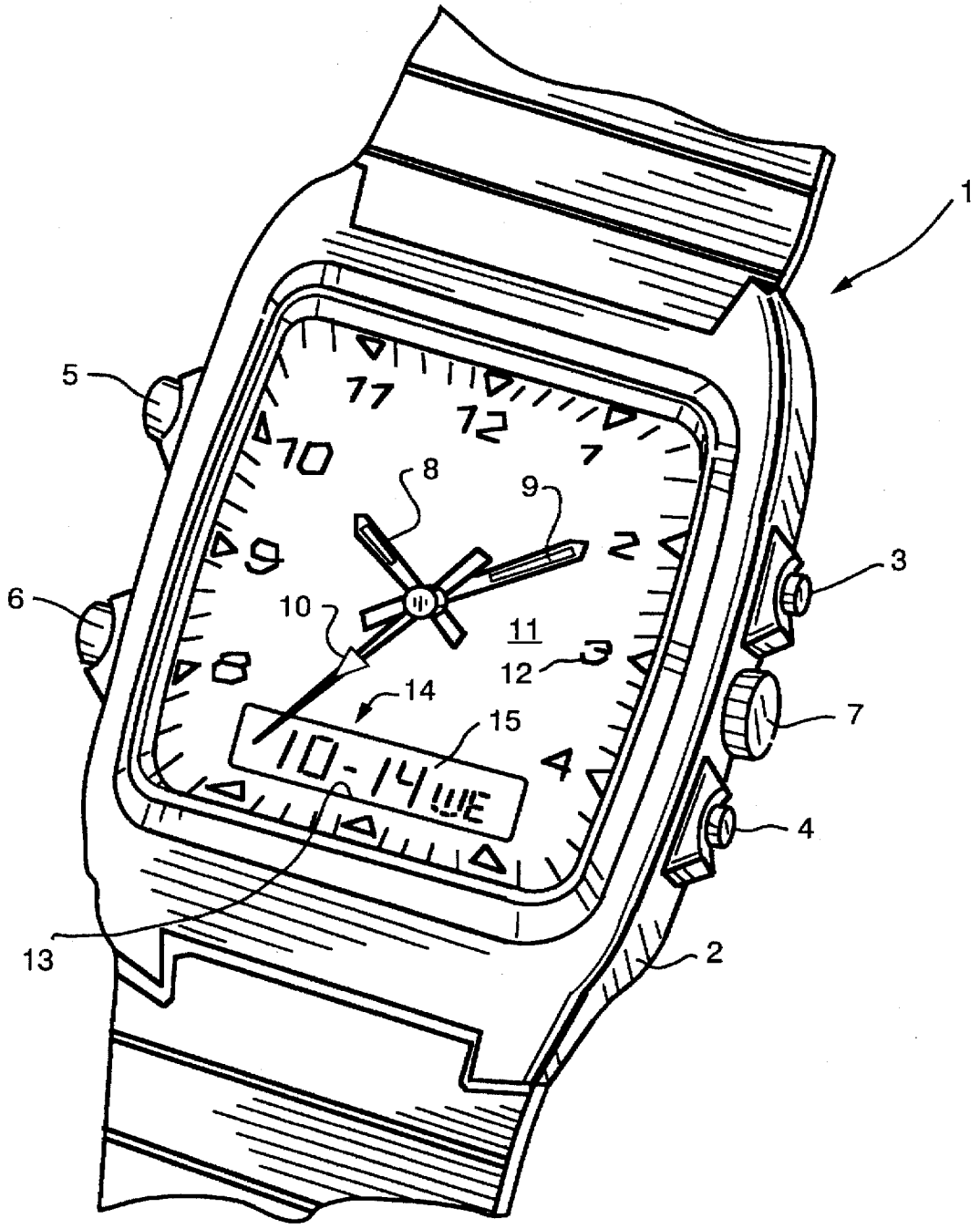

FIG. 1 of the drawing illustrates a combination digital and analog wristwatch 1 comprising a movement contained within a case 2 adapted to be held on the wrist by means of a conventional band, strap or bracelet. Protruding from opposite sides of the case are pushbutton actuators 3, 4, 5, 6 and a crown 7 utilized to set the analog hands of the wristwatch.

Figure 4:
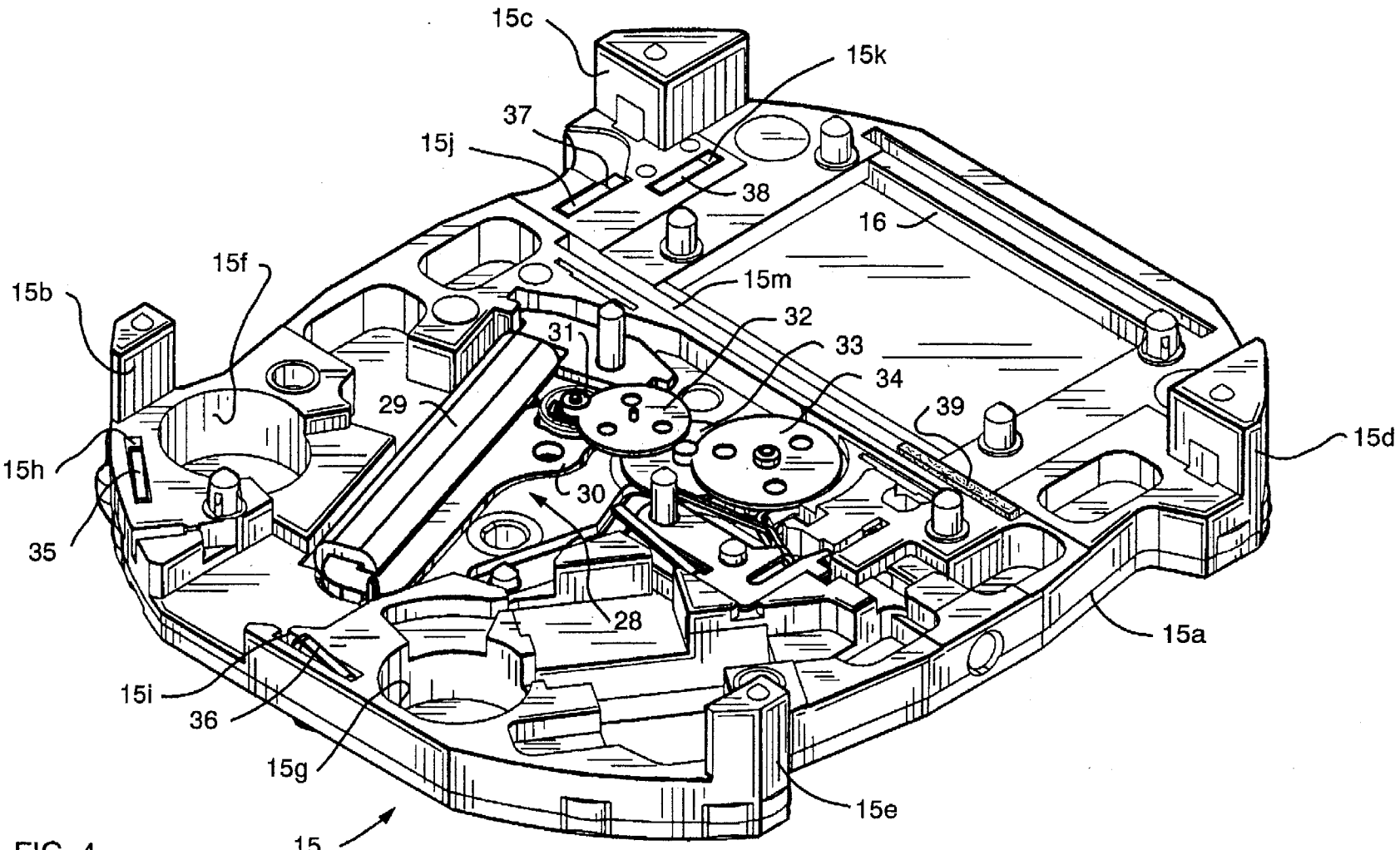

Hour hand 8, minute hand 9 and second hand 10 are operated by a gear train driven by a stepping motor within the movement (FIG. 4). An analog dial 11 of generally rectangular shape to fit case 2 is provided with timekeeping indicia 12 and adapted to be illuminated by means to be described. Dial 11 includes a window opening 13, which exposes a liquid crystal display 14 having a pattern of digital segments 15 actuated in a conventional manner by a liquid crystal driver circuit within the movement. The digital segments 15 are part of a pattern which is framed by window 13 and capable of displaying either time of day in digital format, or in the case shown, the month, calendar day and day of the week. The digital display is adapted to be illuminated by an electroluminescent lamp in a manner to be explained.

Figure 2:
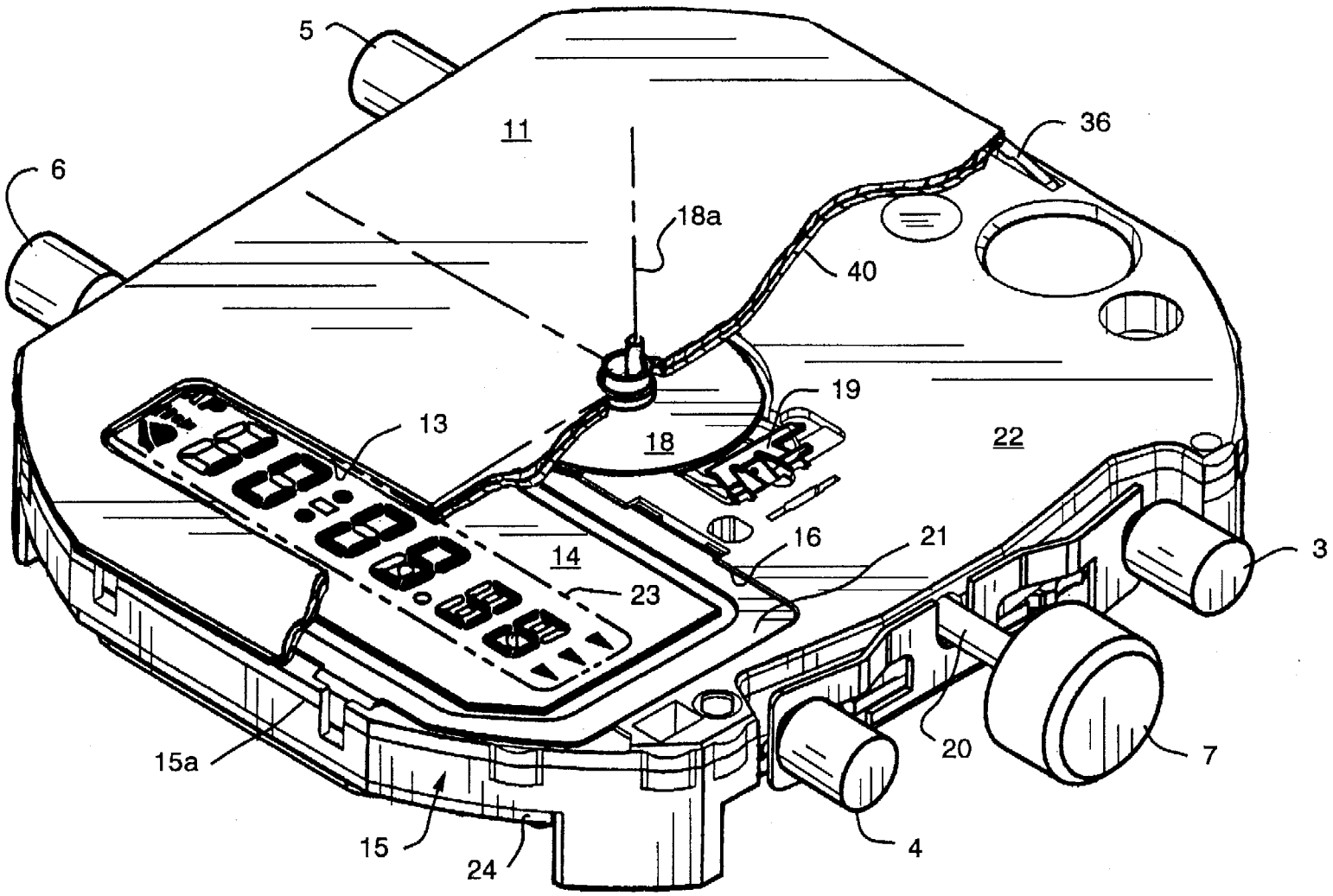

Referring to FIG. 2 of the drawing, a perspective view of the movement is shown with portions of dial 11 cut away, illustrating that the liquid crystal display 14 is held within a plastic frame 15, by being inset into a recess 16 in the frame. Frame 15 of the movement is a single piece molding of polycarbonate resin of complex and intricate shape (see FIG. 4) which contains the mechanical components of the analog stepping motor and gear train, as well as recesses for the discrete electronic components utilized in the timepiece. Reference number 15*a* indicates the mold separation line. The analog hands, not shown, rotate coaxially about the axis 18*a* of an hour wheel 18 of the analog part of the movement. FIG. 2 also shows portions of a holding plate 19, which cooperates with a setting stem 20 attached to crown 7 in a known manner. Details of such a mechanism may be seen by reference to U.S. Pat. No. 4,794,576 issued Dec. 27, 1988 to H. Schwartz et al. The axis 18*a* of the hour wheel 18 is disposed substantially in the center of the movement frame 15.

The liquid crystal display 14 is held within recess 16 by means of a surrounding metal frame 21, so as to be flush with an upper surface 22 of frame 15 on the dial side of the frame. The size and available surface area of liquid crystal display 14 is considerably larger than the size of a digital indicia pattern 23 denoted by phantom lines. The window opening 13 in dial 11 is designed to frame the indicia pattern 23, so that the remainder of the available surface area of LCD 14 is covered. The remainder of the surface area of watch dial 11 which is not occupied by window opening 13 is available for graphics or timekeeping indicia patterns of many different styles.

The available surface area of the liquid crystal display 14 is made as large as possible, leaving only the minimum space required around the display 14 to support it within the frame 15 and the metal frame 16. One dimension of display 14 extends substantially across the width of frame 15. The other dimension of display 14 extends substantially from the edge of frame 15 to the outer edge of hour wheel 18. It can go no further than the hour wheel 18 without interference with the rest of the analog gear train.

Figure 3:
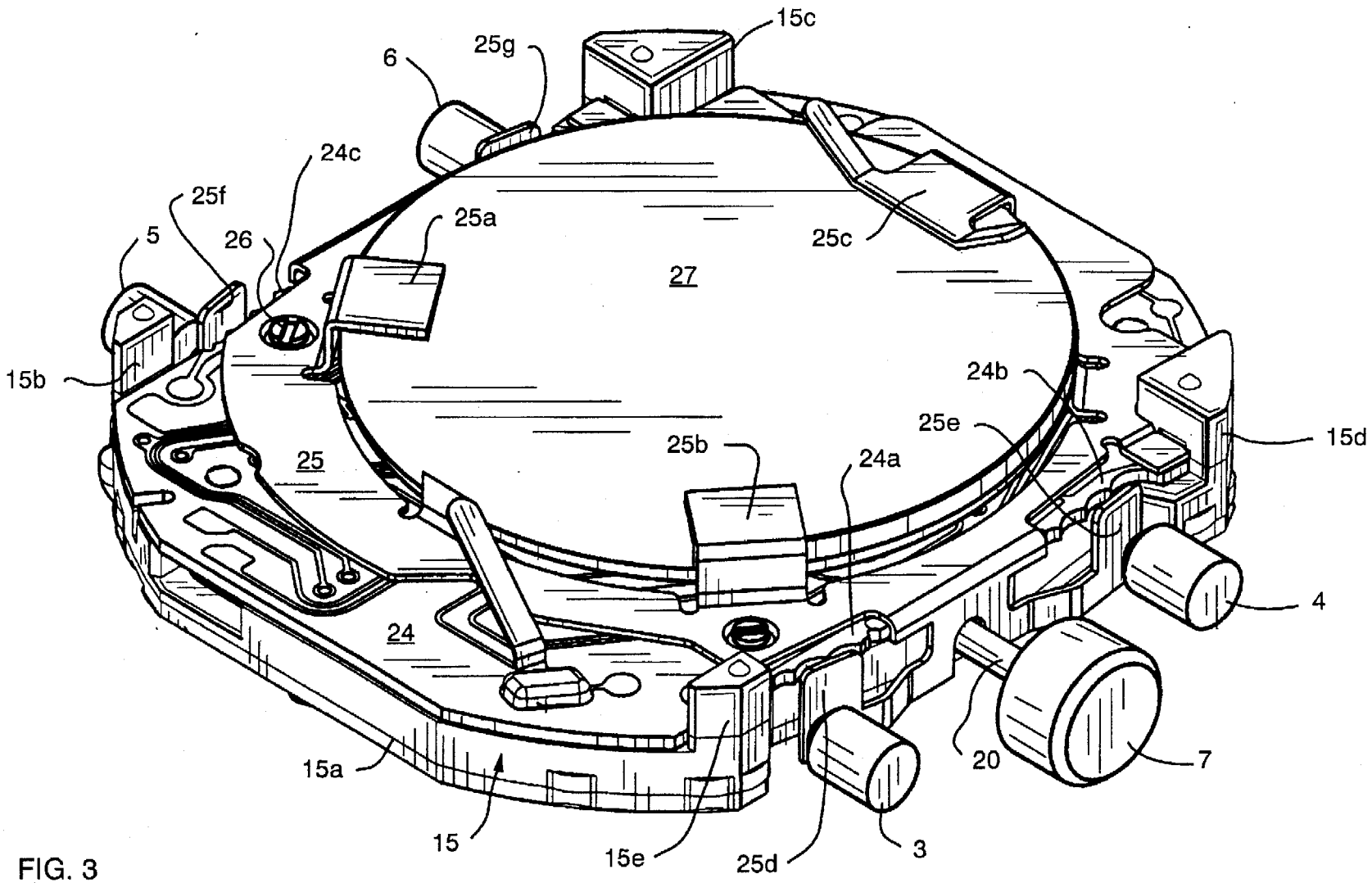

The opposite or movement side of the frame 15 may be seen in FIG. 3, which is generated by rotating the movement 180° around the axis of stem 20. See also FIG. 4 which is the same view of the frame 15 with selected members removed.

Referring first to FIG. 3, the top of frame 15 is covered by a printed circuit board 24. Above the printed circuit board 24 is a dual pushbutton and energy cell contact and holding spring 25 (referred to hereinafter as the holding spring) held in place by screws 26. The energy cell itself is seen at 27, held in place by clamping tabs 25*a*, 25*b* and 25*c* of the holding spring 25. Tab 25*c* includes a pair of upwardly extending grounding wings which contact the back of case 1, and ground the exposed terminal of energy cell 27. Frame 15 is supported in case 1 on four pillars 15*b*, 15*c*, 15*d*, 15*e*. Depending tabs 25*d*, 25*e*, 25*f* and 25*g* of the holding spring serve as spring contact switch elements actuated by pushbuttons 3, 4, 5, 6 respectively to make contact with conductive inserts, such as 24*a*, 24*b*, 24*c*, 24*d* (obscured) respectively, located on the printed circuit board. For example, depression of pushbutton actuator 3 against spring tab 25*d* depresses it so as to contact insert 24*a* on the printed circuit board. This connects insert 24*a* to the potential on one side of energy cell 27, which is also connected to ground. The circuit is suitably arranged to carry out a desired result when pushbutton 3 is depressed and elements 25*d* and 24*a* contact one another, to illuminate either one or both displays.

Referring to FIG. 4, frame 15 is shown with energy cell 27, spring 25 and printed circuit board 24 removed, so as to reveal other elements of the movement. A stepping motor 28 with a coil 29 and stator 30 drives a gear train partly consisting of a stepping motor rotor 31, intermediate wheel assembly 32, seconds wheel 33 (whose axis is located in the center of the movement), and third wheel assembly 34. The latter turns the center wheel (not shown) and other gear members conventional in an analog watch movement. The gear train is covered and held in place by a bridge (not shown). Frame 15 includes recesses such as 15*f*, 15*g* for housing discrete electronic components such as capacitors, quartz crystal, inductors and so forth, which are attached to and electrically connected to the circuit on the printed circuit board.

In accordance with the present invention, a number of connector slots are formed in the frame for holding yieldable electrical connectors extending between the printed circuit board and the illuminated displays. Slots 15*h* and 15*i* extend through the frame on one edge and serve to house the respective yieldable electrical connectors, comprising metal spring connectors 35, 36. Slots 15*j*, 15*k* extend through the frame and serve to house respective yieldable electrical connectors comprising elastomeric conductive members 37, 38. Lastly, slot 15*m* extends through the frame and houses an elastomeric "zebra" strip 39, which contacts a plurality of terminals connected to the liquid crystal display segments.

Figure 5:
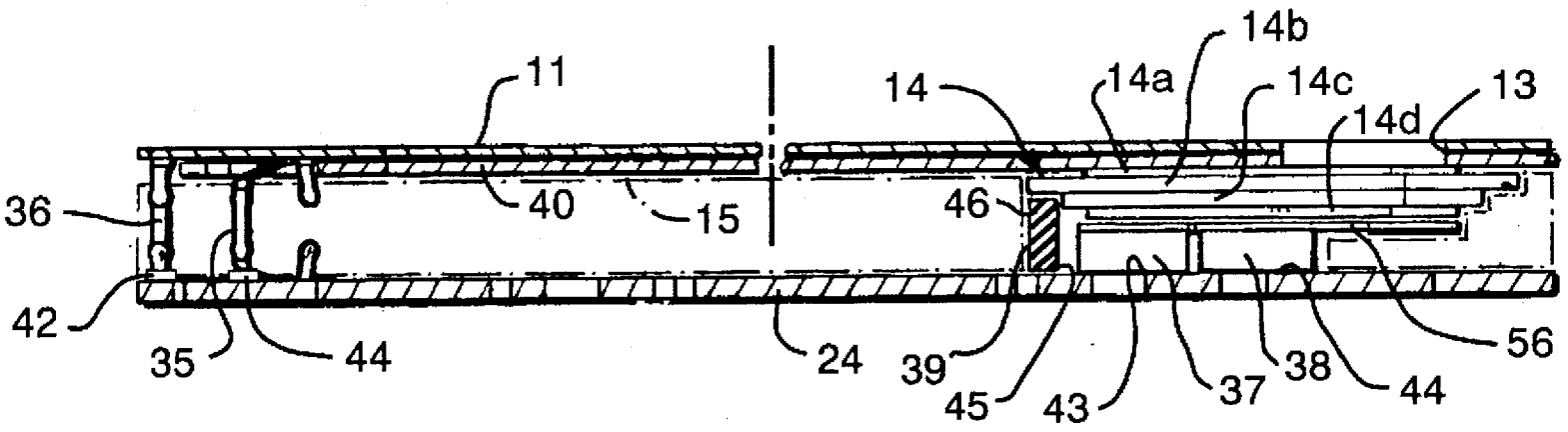

Referring to FIG. 5 of the drawing, a cross section is shown to illustrate the principle of the invention. The printed circuit board 24 is spaced and separated from the dial member 11 by frame 15, shown in phantom lines. Dial 11 may be constructed in accordance with the teachings of the aforesaid U.S. Pat. No. 4,775,964—Alessio. Dial 11 may be arranged for electrical contact with its front and back electrodes by means of the construction described in the aforementioned U.S. Pat. No. 5,265,071 to Thorgersen et al. The dial is supported on a dial standard or support plate designated by reference 40. See also FIG. 2. Dial standard 40 is co-extensive with dial 11, with the exception of areas in the vicinity of the two contact springs 35, 36. A plurality of suitable contact pads 41, 42, 43, 44 on printed circuit 24 are connected to the appropriate electroluminescent drive circuit elements.

A conventional liquid crystal display 14 comprises top polarizer 14*a*, upper glass plate 14*b*, lower glass plate 14*c* and a lower transflective polarizer 14*d*. A plurality of contact terminals connected to the indicia segments are located at 46 on the lower side of the upper glass plate 14*b*. Another plurality of contact terminals on the printed circuit board, designated by reference number 45 are connected to the liquid crystal driver circuit. Normally, this driver circuit is multiplexed so as to provide common signal drivers and segment signal drivers to the conductive segments. The zebra connector 39 (see FIG. 4) serves as a yieldable electrical connector between the respective plurality of contact terminals 46 on the LCD and the plurality of contact terminals 45 on the printed circuit board.

Figure 6:
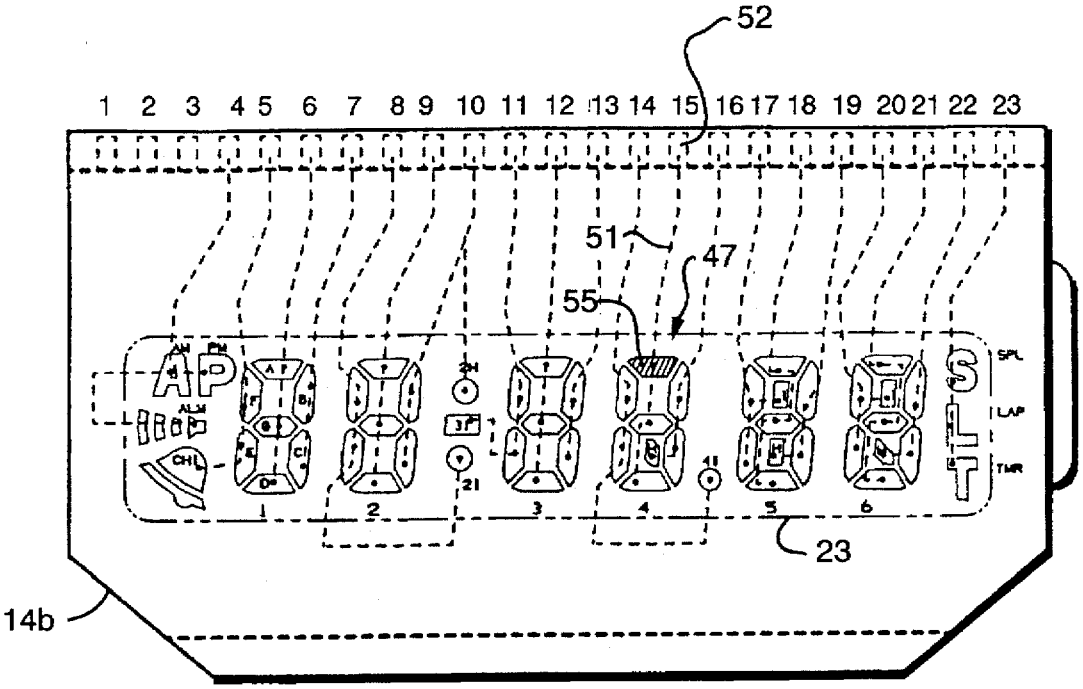
Figure 7:
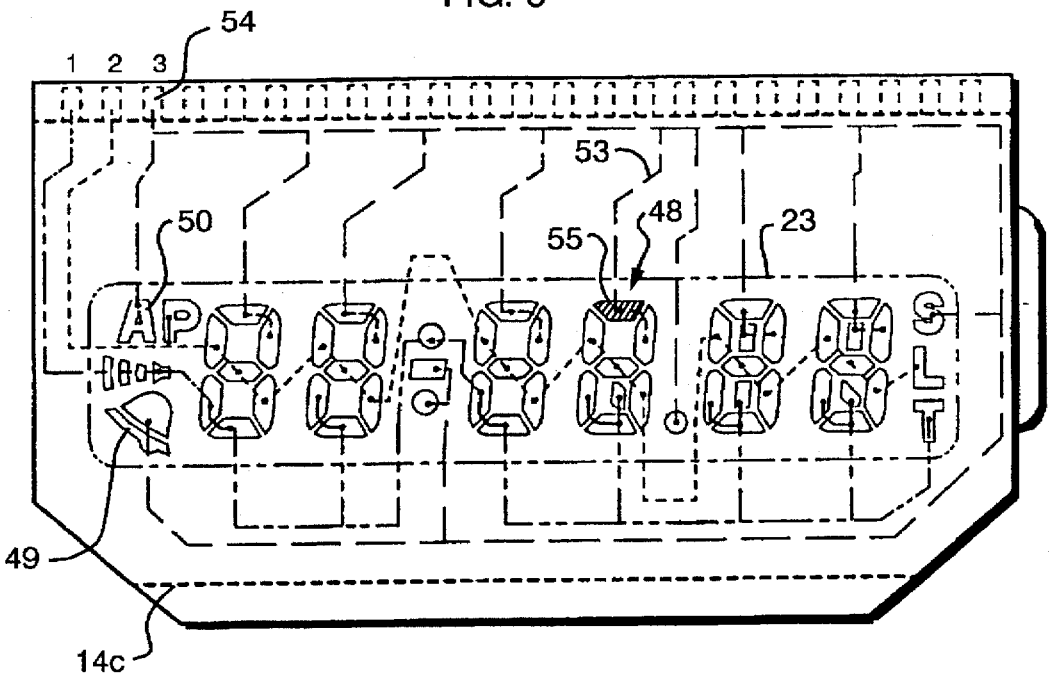

Referring to FIGS. 6 and 7 of the drawing, the patterns on the top glass plate **14*b* and bottom glass plate 14*c* are illustrated. The indicia pattern 23 consists of several seven segment digits 47 on top plate 14*b* with aligned matching digits 48 on the bottom plate. Other indicia include graphic FIGS. 49 and alphabetic characters 50. All indicia are connected to external contact terminals 46 exposed outside the display on the underside of plate 14*b*. Selected segments on the top plate 14*b* are connected by lead lines 51 to such a contact terminal 52. Other selected common segments on bottom plate 14*c* are connected by a lead line 53 to one of three common contact terminals 54. Application of drive signals to terminals 52 and 54 at the same time cause only one segment 55 to become opaque and hence visible in a known manner, either in ambient light, or when illuminated from beneath display 14**.

Referring to FIG. 5, an electroluminescent lamp 56 may be seen disposed beneath LCD 14. This may be constructed in accordance with the teachings of the aforementioned Alessio patent, or may comprise a commercially available electroluminescent lamp available from a company such as Durel Corporation. Conductive elastomeric members 37, 38 extend between contact pads 43, 44 on printed circuit board 24 and the front and back electrodes on the underside of EL lamp 56.

The EL dial 11 is illuminated through a separate connection. Spring clips 35, 36 make contact with pads 41, 42 respectively on one side of the frame and make contacts with electroluminescent front and back electrodes on the underside of dial 11 on the opposite side of the frame 15. The spring clips 35, 36 shown in FIGS. 4 and 5 are C-shaped metallic spring members. Alternatively elastomeric conductive members such as those shown at reference number 57 in FIG. 8 may be substituted.

By this means, the EL dial 11 may be activated from the appropriate circuit on printed circuit board 24 through the yieldable spring connectors 35, 36. In a similar manner, the electroluminescent lamp 56 disposed beneath the liquid crystal display 14 may be separately actuated by appropriate circuits on printed circuit board 24 through the electrical connections provided by the yieldable conductive members 37, 38. The LCD 14, is actuated in conventional fashion to display indicia viewable through window 13 by means of the electrical connection afforded by zebra connector 39.

Referring now to FIGS. 8 through 15 of the drawing, several different designs for combination digital and analog wristwatches are shown in the respective figures. The movement construction previously described in connection with FIGS. 1–5 is identical in all of the FIGS. 8–15 with only three exceptions. First, the patterns of digital indicia elements are different, being laid out in various shapes and sizes and consisting of a different arrangement of segments on the upper and lower glass plates of the LCD and the associated lead lines. However, this does not require a change in size and shape of glass plates, but only a change in patterns added to the plates during the manufacturing process. Secondly, software changes are necessary to operate a different digital display pattern, consisting of software modifications in the ROM of the watch circuit, but requiring no changes in the mechanical or physical aspects of the timepiece movement. Thirdly, the dial shapes and graphics may be changed, together with modifications in the window openings so as to conform to and frame the altered digital indicia patterns on the liquid crystal display. The frame assembly and its major components, including the analog portion and the LCD portion of the movement are physically unaltered.

Figure 8:
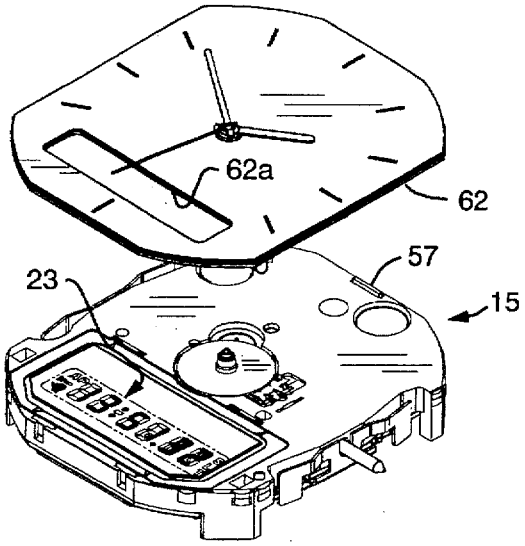

In all of FIGS. 8–15, the physical aspects of the movement frame are identical to those previously described, the movement frames FIGS. 8–15 being designated by the single reference number 15 to illustrate this identity. FIG. 8 corresponds essentially to FIG. 2 with respect to dial shape and window opening.

Figure 9:
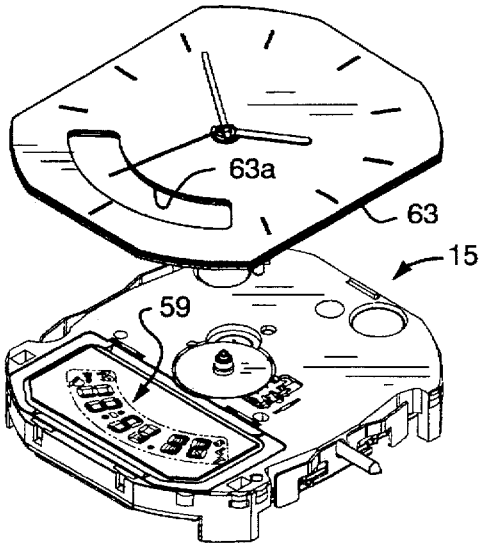
Figure 10:
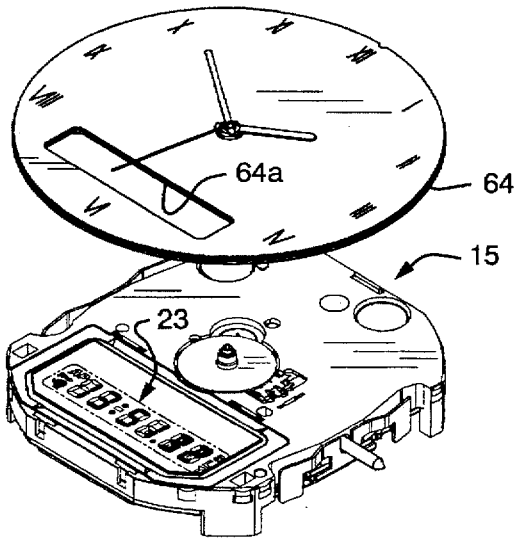

FIGS. 8 and 10 illustrate that an indicia pattern 23 is substantially the same as previously described in FIGS. 2, 6 and 7. FIGS. 9 and 10 illustrate a different indicia pattern 59, which contains the same elements as those of pattern 23, except the segments are laid out on an arc. This does not require different LCD plates, but is only a matter of changing the conductive pattern applied to the plates in the manufacturing process. The ROM and software do not need to be changed.

Figure 11:
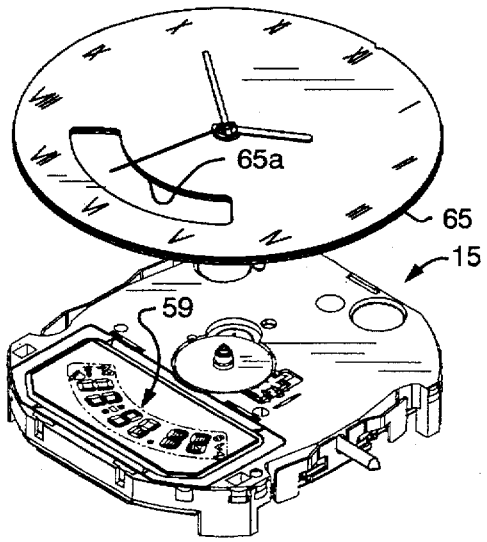
Figure 12:
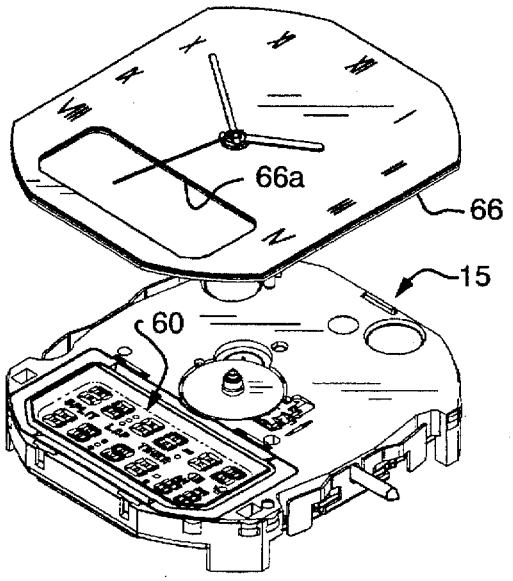
Figure 13:
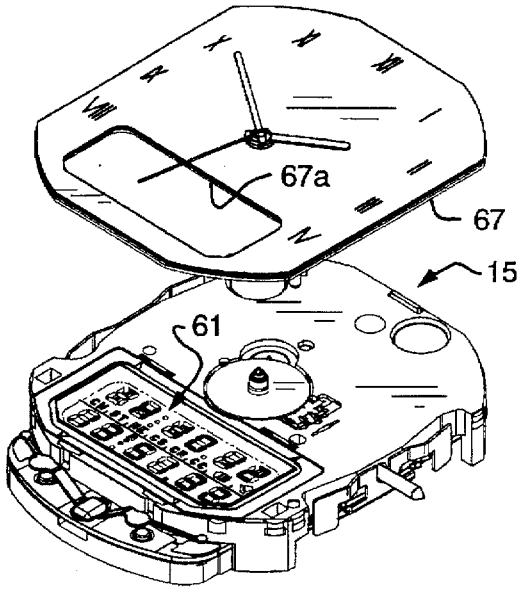
Figure 14:
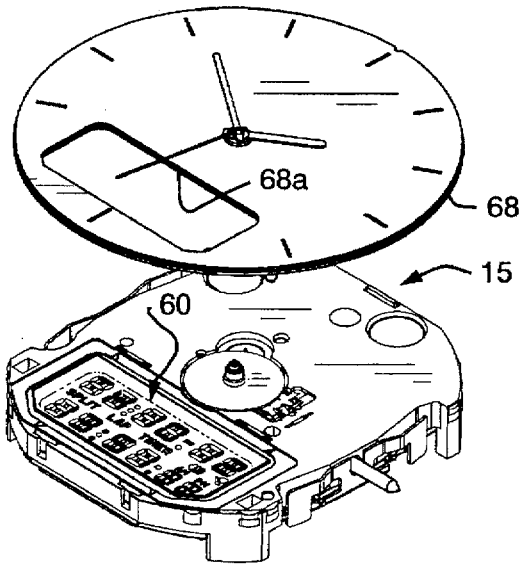
Figure 15:
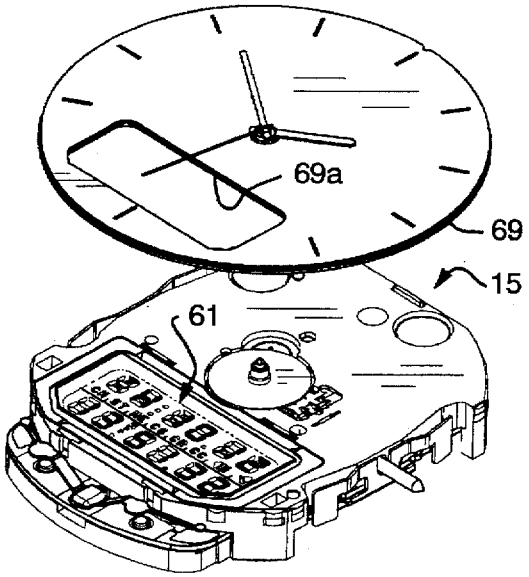

FIGS. 12 and 14 employ a "twelve digit" indicia pattern 60, which occupies a greater portion of the available space on the LCD. Appropriate changes in the software and ROM of the watch circuit are required to generate and actuate this digital indicia pattern. FIGS. 13 and 15 employ a digital pattern 61 of approximately the same size, but arranged to display a different type of digital information. The analog dials used in FIGS. 8–15 may be altered to provide different graphics, as well as to accommodate the varying digital display patterns. FIGS. 8 and 9 illustrate rectangular dials 62, and 63 respectively with the same analog timekeeping indicia, but differ in the shape of their respective window openings **62*a*, 63*a*. Opening 62*a* is the correct shape to frame indicia pattern 23, while arcuate opening 63*a* is the correct shape to frame pattern 59**.

FIGS. 10 and 11 illustrate circular dials 64, 65 with the same indicia, but whose respective window openings **64*a*, 65*a* are designed to frame indicia patterns 23, 49**.

Dials 66, 67 shown in FIGS. 12, 13 respectively are rectangular with identical analog indicia. Dials 68, 69 shown in FIGS. 14, 15 respectively are round with identical analog indicia. All four dials 66, 67, 68 and 69 have the same size and shape of window opening **66*a*, 67*a*, 68*a*, 69*a* to frame the indicia patterns 60, 61**. The latter patterns vary in appearance but are contained within the same digital pattern size and shape.

Therefore the same movement will be used with many varieties of illuminated dials and many layouts of LCD illuminated indicia to create a variety of styles with minimum physical changes in the basic movement.

While there has been described what is considered the preferred embodiment of the invention, other modifications will occur to those skilled in the art, and it is desired to secure in the appended claims all such modifications as fall within the true spirit and scope of the invention.

We claim:

1. An improved illuminated watch movement with analog and digital features of the type having a movement frame with a movement side and a dial side and having a stepping motor and gear train disposed on the movement side connected to operate analog hands disposed on the dial side to rotate coaxially with an hour wheel having an axis and having a liquid crystal display with at least one row of actuatable digits thereon, and having an analog dial with a window for viewing said digits, the improvement comprising:

a recess defined in the dial side of the movement frame, said liquid crystal display disposed in said recess and having an indicia pattern thereon, said liquid crystal display having a first dimension which extends substantially across the width of the movement frame and having a second dimension which extends substantially from an edge of the frame to the outer edge of the hour wheel, said indicia pattern having a size and shape selected from a group consisting of a. a single arcuate line of digits extending substantially over the available surface of the liquid crystal display, b. two rows of digits extending substantially over the available surface of the liquid crystal display, c. a single row of digits extending over a portion of the liquid crystal display substantially smaller than the available surface of the liquid crystal display, an electroluminescent lamp disposed beneath said liquid crystal display, said analog dial comprising an electroluminescent dial disposed on the dial side of the movement frame and adapted to receive the axis of the hour wheel in the center of the dial, said dial defining a window opening therethrough framing the size and shape of the indicia pattern, and circuit means connected to selectively actuate the electroluminescent lamp and/or the electroluminescent dial.

2. The improvement according to claim 1, and further including a printed circuit board disposed on the movement side of the movement frame and having first and second sets of contact pads thereon, a first set of yieldable electrical connectors extending between the first set of contact pads and the electroluminescent dial, and a second set of yieldable electrical connectors extending between the second set of contact pads and the electroluminescent lamp.

3. The improvement according to claim 2, wherein at least one of said sets of yieldable electrical connectors comprises electrically conductive elastomeric members.

4. The improvement according to claim 2, wherein at least one of said sets of yieldable electrical conductors comprises C-shaped electrically conductive metallic spring members.

5. The improvement according to claim 2, and further including a conductive metallic holding spring adapted to hold an energy cell on the movement side of the movement frame and to make contact therewith, said holding spring further including a plurality of spring tabs arranged to selectively contact the printed circuit board when manually actuated.

6. The improvement according to claim 1, wherein the circuit means are connected to actuate the electroluminescent lamp and the electroluminescent dial at the same time.

7. The improvement according to claim 1, wherein the circuit means are connected to separately actuate the electroluminescent lamp and the electroluminescent dial.

* * * * *